US009220324B1

(12) United States Patent
Nunn

(10) Patent No.: US 9,220,324 B1
(45) Date of Patent: Dec. 29, 2015

(54) BREAKAWAY ZIPPER WITH NOTCHED BOX AND ELONGATED PIN

(71) Applicant: Daron D. Nunn, Bakersfield, CA (US)

(72) Inventor: Daron D. Nunn, Bakersfield, CA (US)

( * ) Notice: Subject to any disclaimer, the term of this patent is extended or adjusted under 35 U.S.C. 154(b) by 103 days.

(21) Appl. No.: 13/901,314

(22) Filed: May 23, 2013

(51) Int. Cl.
*A44B 19/40* (2006.01)

(52) U.S. Cl.
CPC ..... *A44B 19/403* (2013.01)

(58) Field of Classification Search
CPC ..... A44B 19/403
USPC ..... 24/433
See application file for complete search history.

(56) References Cited

U.S. PATENT DOCUMENTS

| | | | | | |
|---|---|---|---|---|---|
| 2,834,084 | A * | 5/1958 | Morin | 24/412 |
| 2,948,039 | A * | 8/1960 | Sim | 24/433 |
| 3,224,061 | A * | 12/1965 | Taylor | 24/394 |
| 4,539,733 | A * | 9/1985 | Yoshida | 24/396 |
| 4,756,061 | A * | 7/1988 | Jones et al. | 24/433 |
| 4,870,724 | A * | 10/1989 | Fujisaki et al. | 24/433 |
| 4,976,016 | A * | 12/1990 | Takabatake | 24/433 |
| 5,007,145 | A * | 4/1991 | Kim | 24/433 |
| 6,009,602 | A * | 1/2000 | Terada | 24/433 |
| 2004/0205942 | A1* | 10/2004 | Tsaur | 24/433 |
| 2005/0278904 | A1* | 12/2005 | Matsumoto et al. | 24/433 |
| 2009/0049658 | A1* | 2/2009 | Takasawa et al. | 24/401 |
| 2013/0061436 | A1* | 3/2013 | Peters et al. | 24/430 |

* cited by examiner

*Primary Examiner* — Robert J Sandy
*Assistant Examiner* — Louis Mercado
(74) *Attorney, Agent, or Firm* — Timothy Thut Tyson; Ted Masters

(57) ABSTRACT

A breakaway or pull apart zipper includes an improved retainer box and pin that decrease the chance of a jamb or hang up during unzipping of the zipper. The retainer box has a notch on the distal side that has a lateral stop shorter than one on a conventional retainer box. As such, the pin can rotate out of the retainer box during separation of the zipper sides as the garment is pulled apart instead of having to be pulled up and out of the retainer box. This rotation also causes the slider to tilt into the notch putting it into better alignment with the direction of the force pulling the zipper apart thereby facilitating separation of the pin from the slider and retainer box. The zipper also has a extended pin that loosely fits in the retainer box and goes from the bottom of the retainer box to at least half the slider height when the slider abuts the retainer box and the zipper is ready to come apart. This facilitates the separation process by keeping any flexible tape out of the slider that might jamb in the slider if twisted.

14 Claims, 8 Drawing Sheets

Fig. 12
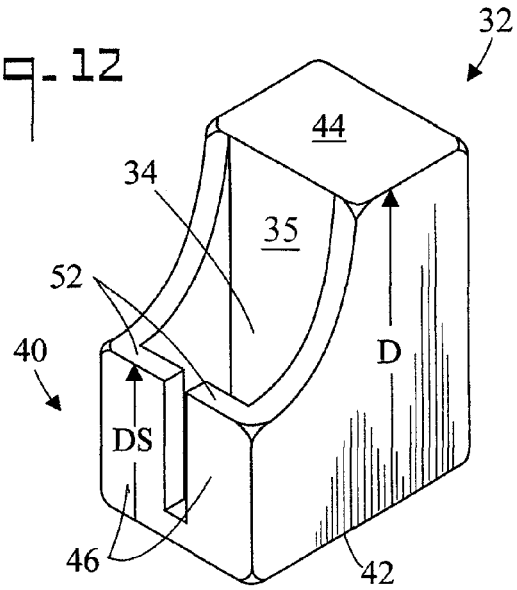
Fig. 13
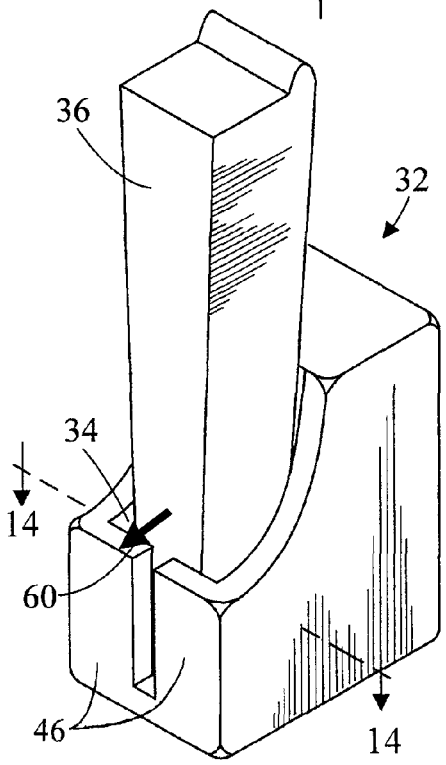
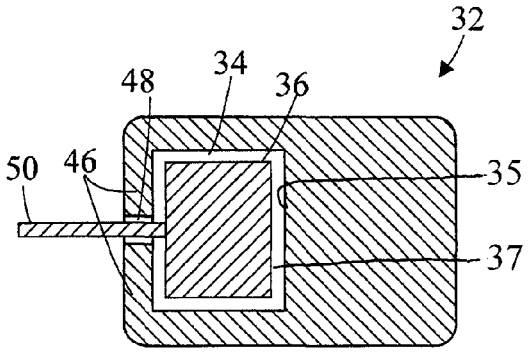
Fig. 14

Fig. 15
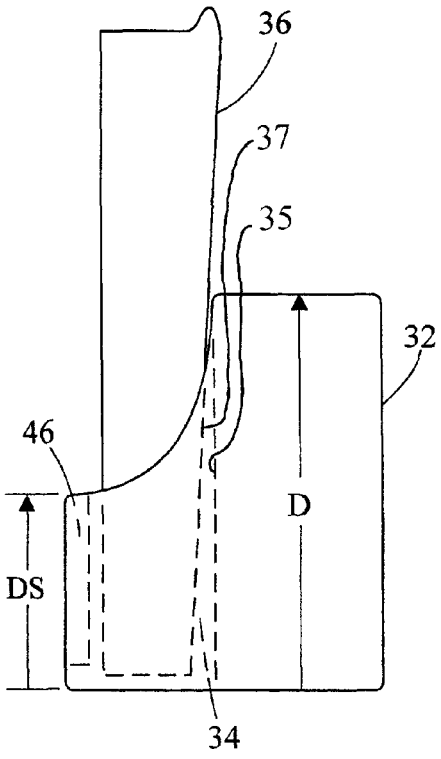
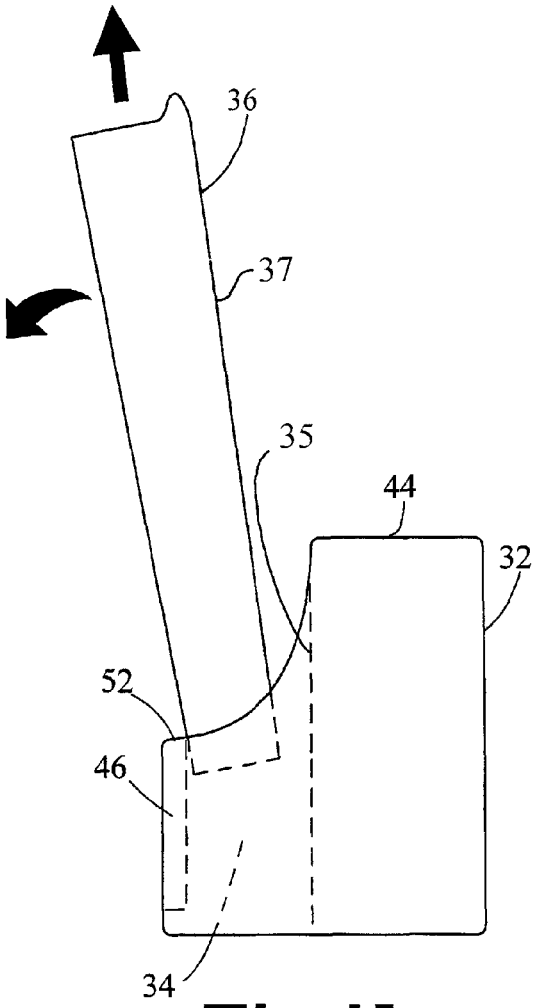
Fig. 16

BREAKAWAY ZIPPER WITH NOTCHED BOX AND ELONGATED PIN

TECHNICAL FIELD

The present invention pertains generally to zippers, and more particularly to a breakaway or pull apart zipper having a notched box and elongated pin.

BACKGROUND OF THE INVENTION

Zippers are well known in the art as a fastening means. These devices employ a slider to selectively connect and disconnect two rows of teeth. The slider has a pull tab for pulling the slider up and down. A catch mechanism is usually provided in the slider for engaging the teeth to hold the slider in a fixed position when the pull tab is not being pulled. A catch mechanism is necessary to keep the slider from moving and unzipping the zipper where there are forces on the opposite sides of the zipper tending to pull it apart such as on clothing and boots. Some sliders do not have a catch mechanism where there are no forces on the opposite sides of the zipper tending to pull it apart such as on luggage. Another example of a use of a slider without a catch mechanism is seen in U.S. Pat. No. 8,127,370 by the present inventor titled Breakaway Sport Pants and Method of Use. These pants have zippers down each leg and are designed to be rapidly pulled apart by disengaging flaps holding the two sliders at the top and then pulling the front of the pants away from the back causing the two sliders to move down the legs without the wearer touching the pull tabs. The pants fall apart when the sliders reach the bottoms of the pants legs releasing the pants entirely from the wearer. In a few rare instances, the pin of a zipper catches or hangs up in the slider or retainer box of the zipper requiring the wearer to reach down and manually remove the pin from the slider and retainer box in order to complete the opening of the zipper and removal of the pants.

BRIEF SUMMARY OF THE INVENTION

The present invention is directed to a zipper for a breakaway sport pants or other garment having a pull apart zipper that provides an improved retainer box and pin that minimize the possibility of the zipper hanging up during unzipping. The retainer box has a notch cut out of the side away from the tape creating a lateral stop that is shorter than the retainer box of a conventional zipper. The shorter lateral stop allows the retainer pin to rotate out of the box during the separation of the sides unlike in regular zippers where the pin must be lifted out of the box. This rotation facilitates separation of the zipper sides and results in less hang ups.

In accordance with an embodiment, a zipper includes a first side that has a first plurality of teeth, and a second side that has a second plurality of teeth, the second side being selectively connectable to the first side by movement of a slider. The first side includes a retainer box having a pin-receiving cavity, and the second side includes a pin that is removably received by the pin-receiving cavity. The retainer box has a proximal edge that is connected to the first side, a distal section, a bottom edge, and a top edge that is disposed a distance from the bottom edge. The distal section includes a lateral stop that prevents the pin from laterally moving out of the pin-receiving cavity. The lateral stop has a top end that is disposed a stop distance from the bottom edge, the stop distance being less than the distance from the top edge to the bottom edge.

In accordance with another embodiment, as the pin is removed from the pin-receiving cavity, the pin outwardly rotates about the top end of the lateral stop.

In accordance with another embodiment, the stop distance is about half of the distance from the bottom edge to the top edge.

In accordance with another embodiment, the stop distance is less than half of the distance from the bottom edge to the top edge.

In accordance with another embodiment, a first curved wall and a second curved wall extend from the distal section to the top edge.

In accordance with another embodiment, the slider has a slider height and the pin has a pin height such that the pin extends into the slider at least half of the slider height when the slider abuts the top edge of the retainer box.

In accordance with another embodiment, as the pin is removed from the pin-receiving cavity, the pin outwardly rotates about the top end of the lateral stop. The outward rotation of the pin causes the slider to tilt or rotate toward the second side where it abuts the top edge, thereby facilitating separation of the first side from the second side.

In accordance with another embodiment, the pin loosely fits within the pin-receiving cavity, thereby facilitating insertion, removal, and outward rotation.

Other embodiments, in addition to the embodiments enumerated above, will become apparent from the following detailed description, taken in conjunction with the accompanying drawings, which illustrate, by way of example, the principles of the zipper.

BRIEF DESCRIPTION OF THE DRAWINGS

FIG. 12 is an enlarged perspective view of the retainer box;

FIG. 13 is an enlarged perspective view of the retainer box with a pin inserted therein;

FIG. 14 is a cross sectional view along the line 14-14 of FIG. 13;

FIG. 15 is an enlarged side elevation view of the pin inserted into the retainer box;

FIG. 16 is an enlarged side elevation view of the pin being removed from the retainer box;

DETAILED DESCRIPTION OF THE INVENTION

Figure 1:
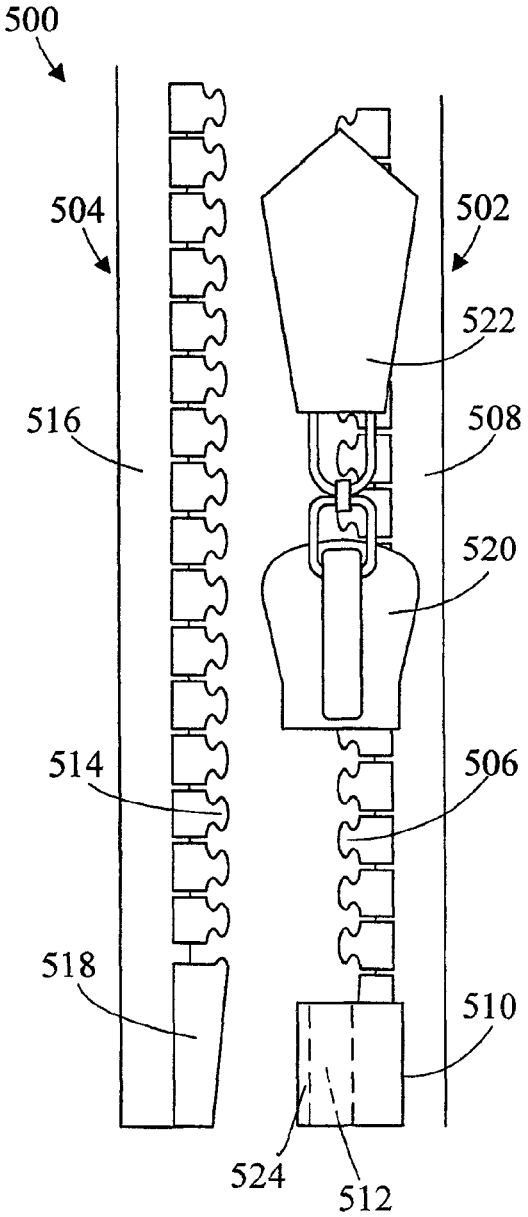
Fig. 1 PRIOR ART
FIG. 1 is a front elevation view of a prior art zipper with a first side and a second side in a disconnected state.

Referring initially to FIG. 1, there is illustrated a front elevation view of a conventional prior art zipper 500 with a first side 502 and a second side 504 in a disconnected state. In the shown embodiment, zipper 500 is a bottom opening zipper such as would be used on a jacket. First side 502 includes a first plurality of teeth 506, a tape 508 that is typically connected to one side of a garment, and a substantially rectangular retainer box 510 that has a pin-receiving cavity 512. Second side 504 includes a second plurality of teeth 514, a tape 516, and a pin 518 that is removably received by pin-receiving cavity 512 of retainer box 510. Second side 504 is selectively connectable to first side 502 by movement of a slider 520 having a pull tab 522. Retainer box 510 includes a lateral stop 524 that prevents pin 518 from moving laterally (perpendicularly with respect to tapes 508 and 516) out of pin-receiving cavity 512 (refer to FIG. 2). Lateral stop 524 is a wall that extends all the way from the top to the bottom of retainer box 510. The wall has a slit for passage of tape 516 (refer to FIG. 2).

Figure 2:
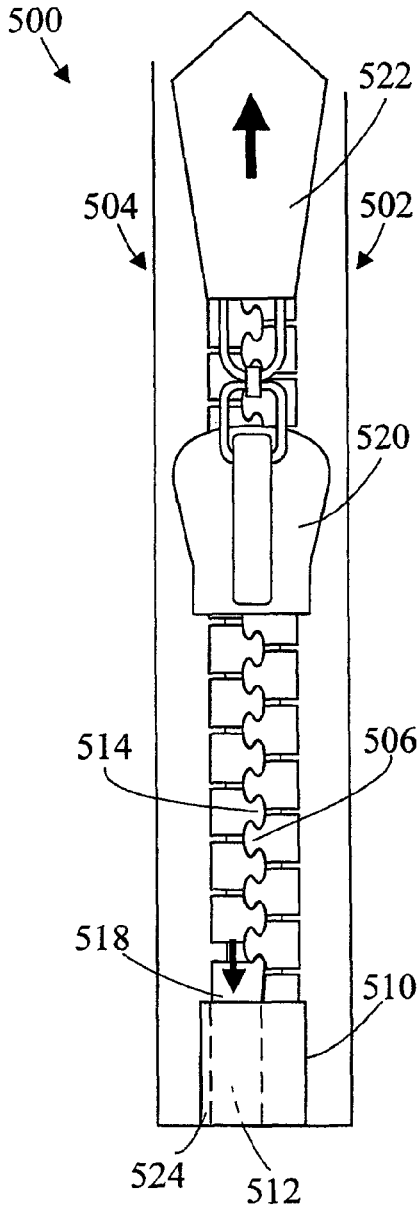
Fig. 2 PRIOR ART
FIG. 2 is a front elevation view of the prior art zipper with the first and second sides in a partially connected state.

FIG. 2 is a front elevation view of prior art zipper 500 with first side 502 and second side 504 in a partially connected state. Pin 518 has been passed through one side of slider 520 and inserted down into pin-receiving cavity 512 of retainer box 510. Slider 520 has then been pulled up by tab 522 causing first plurality of teeth 506 to mesh with second plurality of teeth 514.

Figure 3:
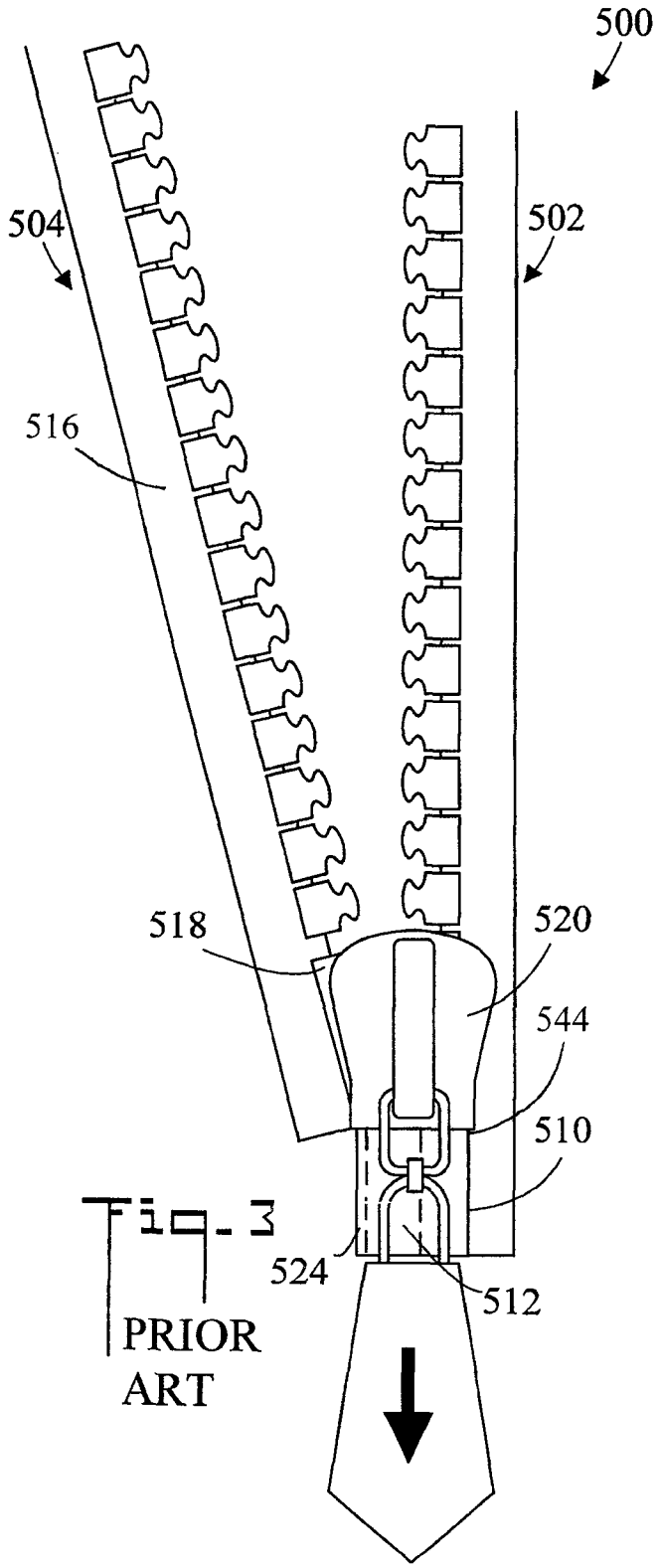
Fig. 3 PRIOR ART
FIG. 3 is a front elevation view of the prior art zipper with the first side separating from the second side.

FIG. 3 is a front elevation view of prior art zipper 500 with first side 502 separating from second side 504. Slider 520 has moved down until it abuts the top edge 544 of retainer box 510. With the teeth 506 and 508 unmeshed, second side 504 is free to move up. Pin 518 also moves up with respect to retainer box 510 out of pin-receiving cavity 512. To effect complete separation, pin 518 must move up until it is completely above lateral stop 524 of retainer box 510 and the top of the slider. However, since lateral stop 524 extends all the way to the top of retainer box 510, pin 518 can sometimes hang up in the retainer box or slider 520 or the tape 516 can twist in the slider causing the zipper to hang up and not come apart without manual manipulation of the parts.

Figure 4:
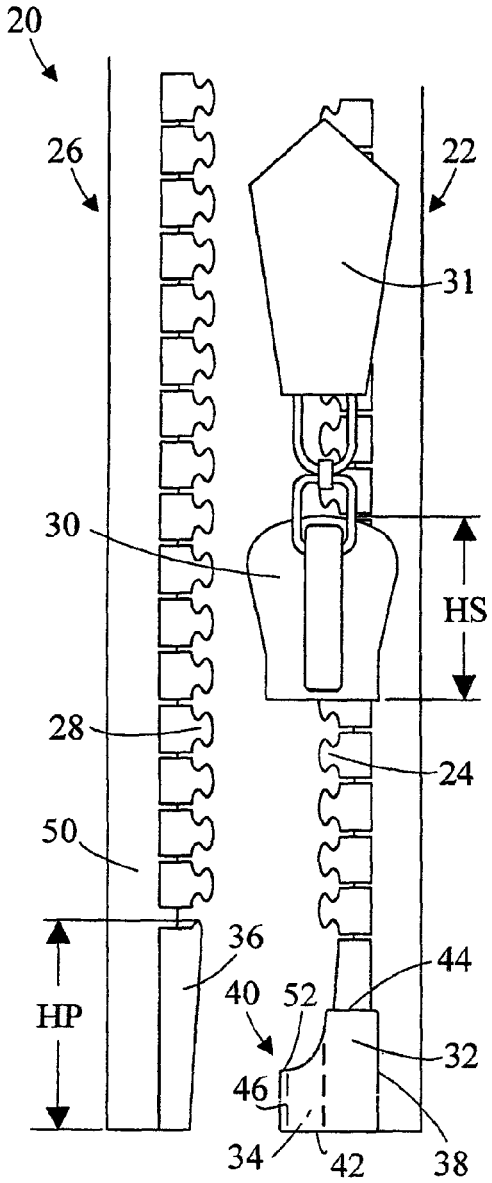
FIG. 4 is a front elevation view of the present zipper with a first side and a second side in a disconnected state.

FIG. 4 is a front elevation view of the present zipper with a first side and a second side in a disconnected state, the zipper generally designated as 20. Zipper 20 includes a first side 22 having a first plurality of teeth 24, and a second side 26 having a second plurality of teeth 28, wherein second side 26 is selectively connectable to first side 22 by movement of slider 30 which has a pull tab 31. First side 22 further includes a retainer box 32 having a pin-receiving cavity 34. Second side 26 includes a pin 36 that is removably received by pin-receiving cavity 34 (refer to FIGS. 13-16). Also referring to FIGS. 8-12, retainer box 32 has a proximal edge 38 that is connected to first side 22, a distal section 40, a bottom edge 42, and a top edge 44 that is disposed a distance D from bottom edge 42. As used herein the terms top and bottom mean closest and furthest respectively from slider 30. Distal section 40 includes a lateral stop 46 that prevents pin 36 from laterally moving out of pin-receiving cavity 34 (refer to FIG. 15). In the shown embodiment, lateral stop 46 includes a wall that has a slot 48 that receives tape 50 of second side 26 (also refer to FIG. 14). Lateral stop 46 has a top end 52 that is disposed a stop distance DS from bottom edge 42. Stop distance DS is less than distance D from bottom edge 42 to top edge 44. As such, lateral stop 46 is shorter than lateral stop 524 of conventional zipper 500.

In another embodiment, slider 22 has a slider height HS and pin 36 has an extended pin height HP such that when the slider abuts the top edge 44 of retainer box 32, pin 36 extends into the slider at least half of the slider height. The result is that only pin 36 is inside most of slider 22 and retainer box 32 when the bottom of the slider abuts the top of the retainer box and the zipper is ready to come apart. This keeps the flexible tape substantially out of the slider such as happens in the prior art where it can twist causing a jamb.

Figure 5:
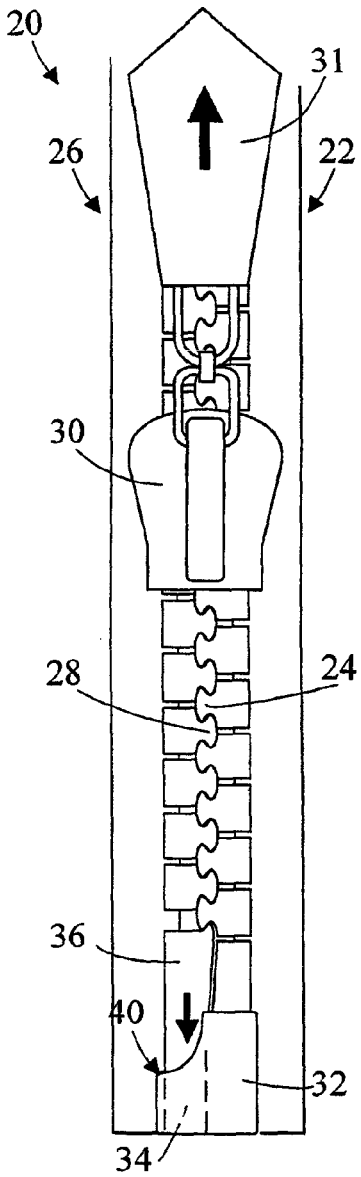
FIG. 5 is a front elevation view of the zipper with the first and second sides in a partially connected state.

FIG. 5 is a front elevation view of zipper 20 with first side 22 and second side 26 in a partially connected state. Pin 36 has been passed through slider 30 and inserted into pin-receiving cavity 34 of retainer box 32. Slider 30 has then been pulled up by pull tab 31 thereby partially meshing first teeth 24 and second teeth 28. This action is used when the user puts on a pair of breakaway pants and zips up the zippers on the pants legs.

Figure 6:
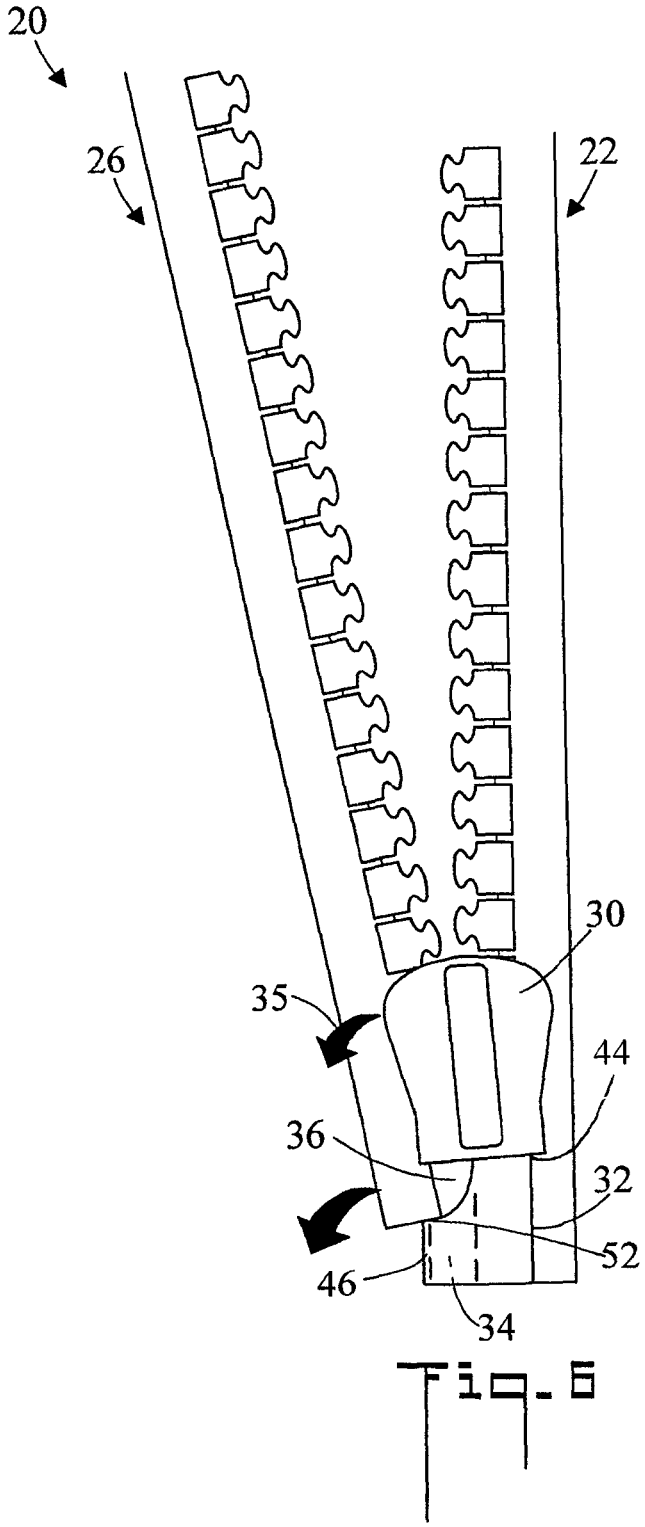
FIG. 6 is a front elevation view of the zipper with the first side separating from the second side.
Figure 8:
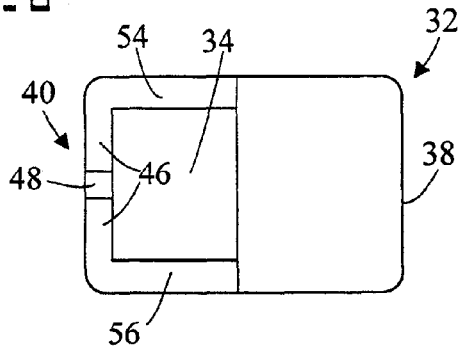
FIG. 8 is an enlarged top plan view of the retainer box.
Figure 7:
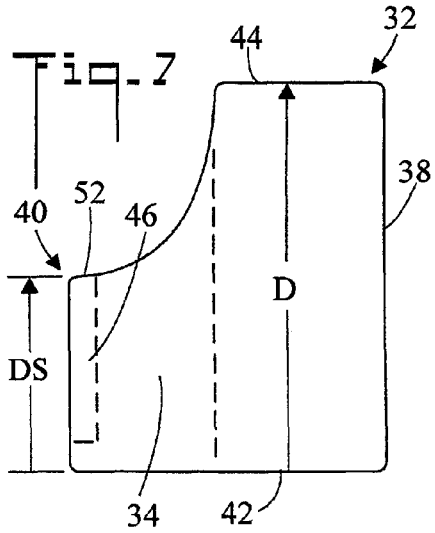
FIG. 7 is an enlarged side elevation view of a retainer box.
Figure 10:
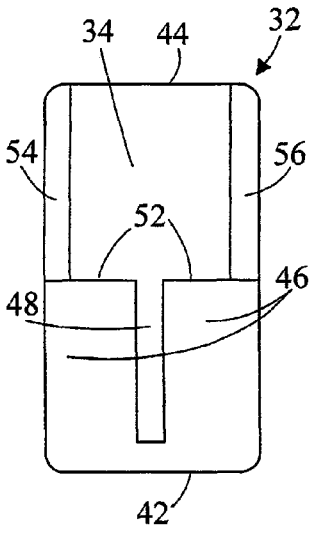
FIG. 10 is an enlarged front elevation view of the retainer box.
Figure 11:
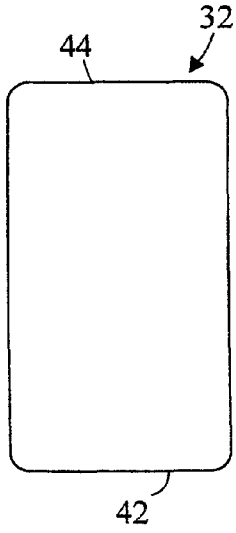
FIG. 11 is an enlarged rear elevation view of the retainer box.
Figure 9:
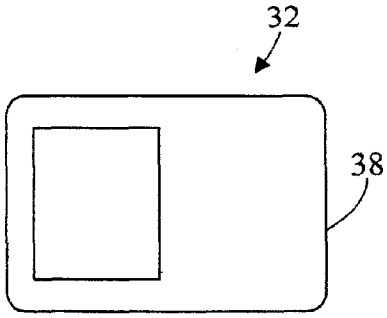
FIG. 9 is an enlarged bottom plan view of the retainer box.

FIG. 6 is a front elevation view of zipper 20 with first side 22 separating from second side 26, as would occur when the front of the breakaway pants is pulled away from the back forcing the zippers to unzip down the pants legs. At the bottom of the zipper, the bottom of slider 30 abuts the top edge 44 of retainer box 32. As the garment sides are continued to be pulled apart, the second side 26 is pulled away from first side 22 causing pin 36 to come out of pin-receiving cavity 34 of retainer box 32 (also refer to FIGS. 13-16). As pin 36 is removed from pin-receiving cavity 34, pin 36 outwardly rotates in the direction of the arrow about top end 52 of lateral stop 46. This rotation facilitates the separation of first side 22 and second side 26. Since lateral stop 46 only extends part way up retainer box 32 and not all the way to top edge 44 as is the case with a conventional retainer box, the rotation occurs earlier in zipper than in prior art zipper 500. The outward rotation of pin 36 also causes the bottom of slider to tilt into the notch in the distal edge of retainer box 32 by rotating on top edge 44 in direction 35 toward second side 26. This tilting of the slider in the direction of the pull on the second side 26 further facilitates the separation of first side 22 from second side 26 by putting the slider in better alignment with the force of the pull so the pin pulls straight out of the slider. The rotation of slider 30 is enhanced by the longer length of pin 36.

FIGS. 7-12 are enlarged side elevation, top plan, bottom plan, front elevation, rear elevation, and perspective views respectively of retainer box 32. Shown are pin-receiving cavity 34 having a back wall 35 substantially in a single plane, proximal edge 38, distal section 40, bottom edge 42, top edge 44, lateral stop 46 having top end 52, tape slot 48, distance D from bottom edge 42 to top edge 44, and stop distance DS from bottom edge 42 to top end 52. In the shown embodiment, stop distance DS is about half of distance D. Also in the shown embodiment, a first curved wall 54 and a second curved wall 56 extend from distal section 40 to top edge 44. First curved wall 54 and second curved wall 56 combine to form a notch (opening) in the top distal section of retainer box 32.

FIG. 13 is an enlarged perspective view of retainer box 32 with pin 36 inserted therein. For clarity, tape 50 which is connected to pin 36 has not been shown (refer to FIG. 4). Pin 36 has been inserted into pin-receiving cavity 34 of retainer box 32. Lateral stop 46 prevents pin 36 from moving laterally out of pin-receiving cavity 34 in direction 60.

FIG. 14 is a cross sectional view along the line 14-14 of FIG. 13. Pin 36 is received by pin-receiving cavity 34 of retainer box 32. Back wall 35 is in a single plane. Pin 36 has a front wall 37 that is also substantially in a single plane. The plane of back wall 35 and the plane of front wall 37 are substantially parallel to and spaced from each other as shown in FIG. 14. Pin 36 is shaped and dimensioned to facilitate outward rotation. That is, the size of pin 36 is reduced so that it loosely fits within pin-receiving cavity 34, thereby facilitating insertion, removal, and outward rotation. Also shown in this view are lateral stop 46 and slot 48 which passes tape 50.

FIG. 15 is an enlarged side elevation view of pin 36 inserted into pin-receiving cavity 34 of the retainer box 32. The plane of back wall 35 and the plane of front wall 37 are substantially parallel to and spaced from each other as shown in FIG. 15. It is observed that pin 36 loosely fits within pin-receiving cavity 34. Also shown are distance D and lateral stop distance DS.

FIG. 16 is an enlarged side elevation view of pin 36 being removed from pin-receiving cavity 34 of retainer box 32, such as when a pair of breakaway sports pants are being unzipped (refer to FIG. 6). During removal, pin 36 rotates about top end 52 of lateral stop 46 thereby facilitating removal. It is noted that the rotation begins well before pin 36 reaches the top edge 44 of retainer box 32. This is in sharp contrast to conventional zipper 500 in which lateral stop 524 extends all the way to the top of retainer box 512. Rotation of pin 518 is then not possible until it nears the top of retainer box 510 (refer to FIGS. 1-3).

Figure 17:
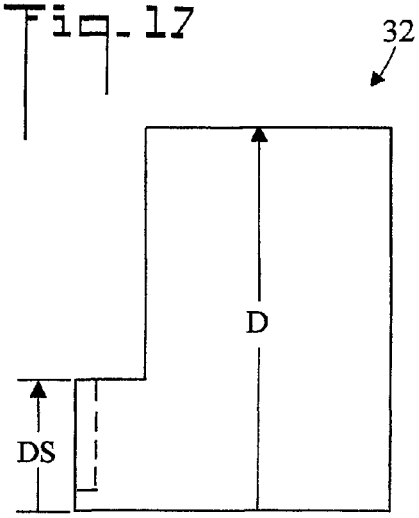
FIG. 17 is an enlarged side elevation view of a second embodiment retainer box.
Figure 18:
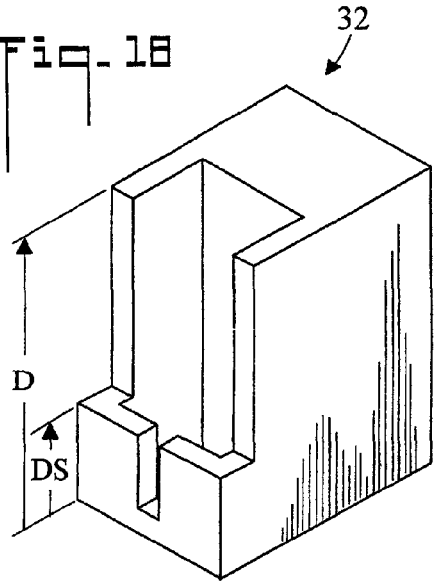
FIG. 18 is an enlarged perspective view of the retainer box of FIG. 17; and, FIG. 19 is an enlarged perspective view of a third embodiment retainer box.

FIGS. 17 and 18 are enlarged side elevation and perspective views, respectively, of a second embodiment retainer box 32. In this embodiment stop distance DS is less than half of distance D. As such, rotation of pin 36 will occur even sooner than in FIG. 16. Also in this embodiment, the curved notch has been replaced by a rectangular one.

Figure 19:
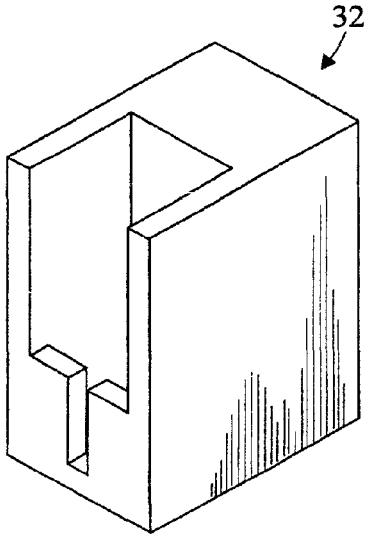

FIG. 19 is an enlarged perspective view of a third embodiment retainer box 32. In this embodiment the side walls do not include a notch or opening.

The embodiments of the zipper described herein are exemplary and numerous modifications, combinations, variations, and rearrangements can be readily envisioned to achieve an equivalent result, all of which are intended to be embraced within the scope of the appended claims. Further, nothing in the above-provided discussions of the zipper should be construed as limiting the invention to a particular embodiment or combination of embodiments. The scope of the invention is defined by the appended claims.

I claim:

1. A zipper, comprising:

a first side having a first plurality of teeth;

a second side having a second plurality of teeth, said second side selectively connectable to said first side by movement of a slider;

said first side including a retainer box having a pin-receiving cavity with a back wall substantially in a single plane;

said second side including a pin with a front wall substantially in a single plane that is removably received by said pin-receiving cavity;

said plane of said front wall of said pin substantially parallel to and spaced from said plane of said back wall of said pin-receiving cavity;

said retainer box having a proximal edge that is connected to said first side, a distal section, a bottom edge, a top edge that is disposed a distance from said bottom edge, and a first curved wall and a second curved wall, said first and second curved walls extending from said distal section to said top edge; and, said distal section including a lateral stop that prevents said pin from laterally moving out of said pin-receiving cavity, said lateral stop having a top end that is disposed a stop distance from said bottom edge, said stop distance being less than said distance.

2. The zipper according to claim 1, further including:

as said pin is removed from said pin-receiving cavity, said pin outwardly rotates about said top end of said lateral stop.

3. The zipper according to claim 1, further including:

said stop distance being about half of said distance.

4. The zipper according to claim 1, further including:

said stop distance being less than half of said distance.

5. The zipper according to claim 1, further including;

said slider having a slider height; and, said pin having a pin height that extends said pin into said slider at least half of said slider height when said slider abuts said top edge of said retainer box.

6. The zipper according to claim 5, further including;

as said pin is removed from said pin-receiving cavity, said pin outwardly rotates about said top end of said lateral stop; and, an outward rotation of said pin causing said slider to rotate toward said second side, thereby facilitating separation of said first side from said second side.

7. The zipper according to claim 1, further including:

said pin loosely fitting within said pin-receiving cavity, thereby facilitating insertion, removal, and outward rotation.

8. A zipper having a first side having a first plurality of teeth, a second side having a second plurality of teeth, the second side selectively connectable to said first side by movement of a slider, the first side including a retainer box having a pin-receiving cavity, the second side including a pin that is removably received by the pin-receiving cavity, the retainer box having a proximal edge that is connected to the first side, a distal section, a bottom edge, and a top edge that is disposed a distance from the bottom edge, the distal section including a lateral stop that prevents the pin from laterally moving out of the pin-receiving cavity, improvements comprising:

a first curved wall and a second curved wall, said first and second curved walls extending from the distal section to the top edge;

the lateral stop having a top end that is disposed a stop distance from the bottom edge, said stop distance being less than the distance;

the pin-receiving cavity having a back wall substantially in a single plane;

the pin having a front wall substantially in a single plane; and, said plane of said front wall of the pin substantially parallel to and spaced from said plane of said back wall of the pin-receiving cavity.

9. The zipper according to claim 8, further including:

as the pin is removed from the pin-receiving cavity, the pin outwardly rotates about said top end of the lateral stop.

10. The zipper according to claim 8, further including:

said stop distance being about half of the distance.

11. The zipper according to claim 8, further including:

said stop distance being less than half of the distance.

12. The zipper according to claim 8, further including;

the slider having a slider height; and, the pin having a pin height that extends the pin into the slider at least half of said slider height when the slider abuts the top edge of the retainer box.

13. The zipper according to claim 8, further including;

as the pin is removed from the pin-receiving cavity, the pin outwardly rotates about said top end of the lateral stop; and, an outward rotation of the pin causing the slider to rotate toward the second side, thereby facilitating separation of the first side from the second side.

14. The zipper according to claim 8, further including:

the pin loosely fitting within the pin-receiving cavity, thereby facilitating insertion, removal, and outward rotation.

* * * * *